US008668378B2

(12) United States Patent
Pellet

(10) Patent No.: US 8,668,378 B2
(45) Date of Patent: Mar. 11, 2014

(54) REGULATING ORGAN COMPRISING AT LEAST TWO BALANCES

(75) Inventor: Gilles Pellet, Le Brassus (CH)

(73) Assignee: Societe Anonyme de la Manufacture d'Horlogerie Audemars Piguet & Cie, Le Brassus (CH)

( * ) Notice: Subject to any disclaimer, the term of this patent is extended or adjusted under 35 U.S.C. 154(b) by 444 days.

(21) Appl. No.: 12/911,990

(22) Filed: Oct. 26, 2010

(65) Prior Publication Data

US 2011/0096636 A1 Apr. 28, 2011

(30) Foreign Application Priority Data

Oct. 26, 2009 (CH) ..... 1630/09

(51) Int. Cl.
*G04B 17/00* (2006.01)

(52) U.S. Cl.
USPC ..... 368/169; 368/127; 368/124

(58) Field of Classification Search
USPC ..... 368/127, 169
See application file for complete search history.

(56) References Cited

U.S. PATENT DOCUMENTS

| | | | | |
|---|---|---|---|---|
| 3,161,012 | A * | 12/1964 | Hug et al. | 368/169 |
| 3,186,157 | A * | 6/1965 | Favret et al. | 368/175 |
| 3,599,423 | A | 8/1971 | Beguin et al. | |
| 3,813,872 | A * | 6/1974 | Nakagawa et al. | 368/169 |
| 7,648,265 | B2 * | 1/2010 | Grossman et al. | 368/178 |
| 7,950,846 | B2 * | 5/2011 | Hessler et al. | 368/169 |
| 2009/0236782 | A1 | 9/2009 | Buhler et al. | |

FOREIGN PATENT DOCUMENTS

| | | |
|---|---|---|
| CH | 45160 | 5/1909 |
| CH | 156801 | 11/1932 |
| CH | 1787468 | 6/1970 |
| CH | 699081 | 1/2010 |
| EP | 1473604 A1 | 11/2004 |
| EP | 1640821 A1 | 3/2006 |
| EP | 2141555 A1 | 1/2010 |
| FR | 2447571 | 8/1980 |
| GB | 16335 | 11/1912 |
| GB | 2 039389 A | 8/1980 |
| WO | WO 2006/032974 A2 | 3/2006 |
| WO | WO 2006/067597 A2 | 6/2006 |
| WO | WO 2008/101802 A2 | 8/2008 |

OTHER PUBLICATIONS

Swiss Search Report dated Jan. 28, 2010, 2 pages.
Internet article "If you thought you had seen it all: Th. Prescher's Double Triple-Axis Tourbillon concept", Mar. 13, 2005, 3 pages.

* cited by examiner

*Primary Examiner* — Amy Cohen Johnson
*Assistant Examiner* — Jason Collins
(74) *Attorney, Agent, or Firm* — Patterson Thuente Pederson, P.A.

(57) ABSTRACT

A regulating organ adapted to be integrated into a mechanical watch, comprising a first balance and a first spiral fastened to an axle, and-at least one second balance, wherein the second balance is fastened on the axle of said first balance.

17 Claims, 3 Drawing Sheets

REGULATING ORGAN COMPRISING AT LEAST TWO BALANCES

RELATED APPLICATION

The present application claims priority to Swiss Application No. CH 01630/09 filed Oct. 26, 2009, which is incorporated herein in its entirety by reference.

FIELD OF THE INVENTION

The present invention concerns a regulating organ adapted to be integrated into a mechanical watch, comprising a first balance and a first spiral, as well as a mechanical watch movement or a watch piece comprising such a regulating organ.

BACKGROUND OF THE INVENTION

The regulating organ of a mechanical watch piece is normally composed of a balance and a spiral, and forms the oscillating part of the movement of the watch piece. This central part constituting the regulating organ, which is on one hand determining the precision of the watch piece by its period of oscillation and on the other hand perceived as being the living heart of an inanimate object by reason of its "beat", has, from the invention of mechanical watches, constantly been the object of improvements and developments.

For instance, in the desire of improving the precision of mechanical watches, namely to improve the precision of the period of oscillation of the regulating organ, it has in the past been proposed to integrate a second spiral in the regulating organ, and this according to variants, in particular by modifying the position of the second spiral. Within the same context are the devices realized in the past wherein the regulating organ is composed of two or several spiral balances disposed on parallel axles. These latter devices are relatively complex and bulky, and consequently rather difficult and costly to produce.

Apart from the technical developments mentioned above and other efforts not mentioned in this description, all aimed at the running precision of the corresponding mechanical watch piece, other technical developments have been realized, which are in particular aiming to enhance the corresponding watches' aesthetic attractiveness. In particular, the regulating organ has, for an already good number of years, been used in a manner to enhance the aesthetic appearance of mechanical watches, for instance by equipping the watch cases with a transparent sapphire bottom so as to make it possible to observe the movement of the watch, in particular the beats of the regulating organ of the watch. This solution presents a disadvantage, in the sense that in order to observe all the elegance of this part of the movement, it is necessary to remove the watch from the bearer's wrist and to turn it around, except for skeletal or tourbillon watches having an opening in the dial and where the observation of the regulating organ is normally done on this side of the watch.

In therefore considering the devices of the prior art briefly reviewed above, it must be observed that it would be desirable to have available a regulating organ for mechanical watch pieces capable of even better satisfying today's requirements as concerns its running precision as well as its ability of being employed so as to visually highlight the movement, and notably its balance.

SUMMARY OF THE INVENTION

The object according to embodiments of the invention is therefore to remedy the shortcomings of the regulating organs currently known, and to realize the advantages mentioned above, in particular to allow the realization of a regulating organ for mechanical watch pieces whose running precision is enhanced without thereby excessively increasing its complexity, the space it occupies, or its production cost, and which is suitable for being visually highlighted in the corresponding mechanical watch, both while the watch is worn, namely across the watch glass, and when the watch is removed from the wrist and turned around, namely across a sapphire bottom in the case of the watch.

To this effect, embodiments of the present invention propose a regulating organ, in particular a regulating organ of a mechanical watch, which is distinguished by the characteristics stated in the claims, as well as a corresponding watch movement, respectively a corresponding watch piece. In particular, a regulating organ according to embodiments of the present invention comprises at least a second balance fastened on the axle of said first balance. It can also comprise a second spiral arranged on said at least second balance.

By these measures, one obtains a regulating organ for mechanical watch pieces which offers a very high running precision owing to the fact of its great inertia achieved without increasing the diameter of the device and, eventually, owing to the fact of being equipped with two spiral springs. With respect to the prior art device using two spirals, the regulating organ according to embodiments of the present invention, also has the advantage of facilitating the start-up of the two spirals, as the presence of a second balance on the same axle almost removes the difficulty of viewing to distinguish between the two spirals, which arose for the person initially regulating the watch in the prior art devices. Moreover, the regulating organ according to the present invention is, because of being equipped with two balances on one axle, evidently ideally adapted for being highlighted across the transparent glasses situated on both sides of a mechanical watch.

Other characteristics, as well as their corresponding advantages, will become evident from the dependent claims, as well as from the description below.

BRIEF DESCRIPTION OF THE DRAWINGS

The attached figures represent, by way of example, an embodiment of the invention.

Figure 1:
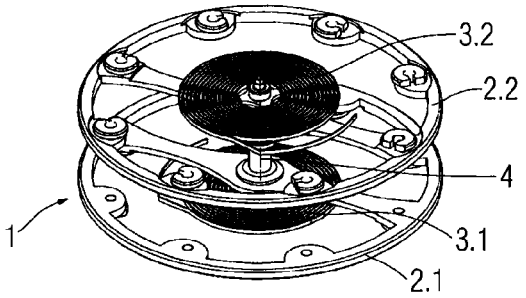
FIG. 1 is a perspective view of a regulating organ according to the present invention.

The invention will now be described in detail with reference to the attached figures, which by way of example illustrate an embodiment of the invention.

DETAILED DESCRIPTION OF THE DRAWINGS

A regulating organ according to embodiments of the present invention is supposed to be integrated into the movement of a mechanical watch piece, in particular into a mechanical watch whose case allows perceiving the movement of the watch and in particular the oscillation of the regulating organ, this preferably from both sides of the watch. As evidenced in FIG. 1, such a regulating organ 1 comprises a first balance 2.1 and a first spiral 3.1, where this balance 2.1 and spiral 3.1 are mounted next to one first extremity 4.1 of the balance axle 4. The regulating organ according to the present invention differs from the devices of the prior art due to the fact that it comprises at least a second balance 2.2 fastened on the same axle 4 as the first balance 2.1, and in a rigid manner with respect to the latter. The second balance 2.2 is preferably mounted next to the other extremity 4.2 of the axle 4, as schematically illustrated in the vertical section of FIG. 2.

Figure 2:
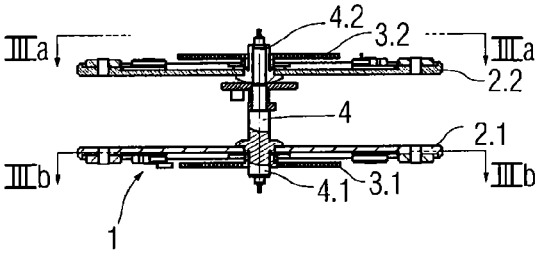
FIG. 2 is a vertical section through the regulating organ according to the present invention.
Figure 3A:
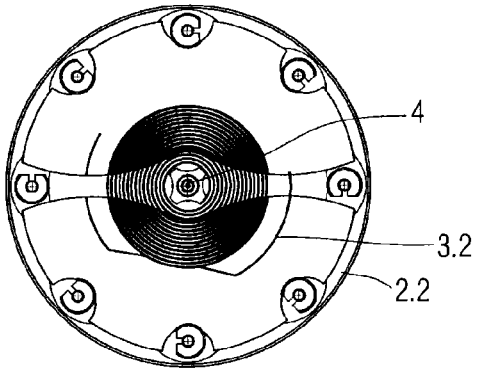
FIG. 3*a* is a top view of the regulating organ according to the line IIIa-IIIa indicated in FIG. 2.
Figure 3B:
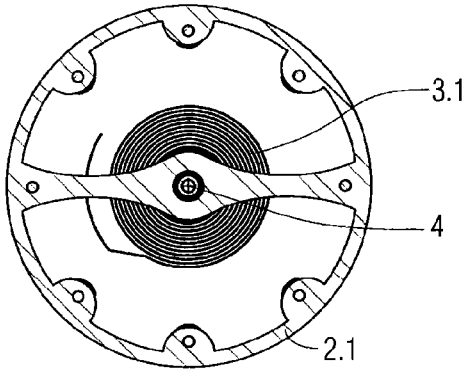
FIG. 3*b* is a top view of the regulating organ, partially shown in a horizontal section across the line IIIb-IIIb indicated in FIG. 2.
Figure 4:
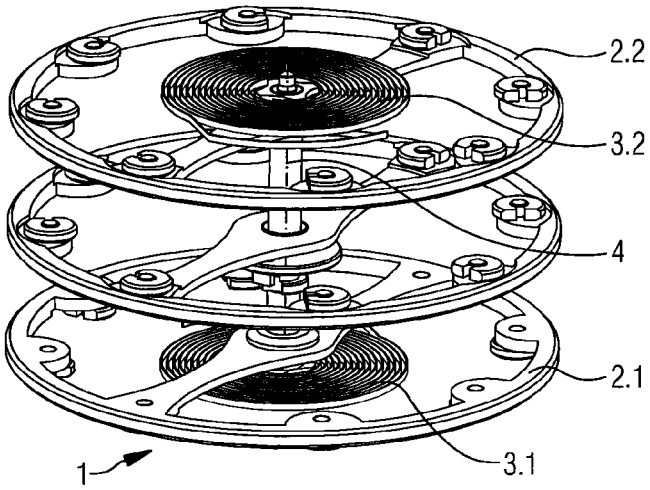
FIG. 4 is a perspective view of a regulating organ with a third balance fastened to the axle in accordance with an embodiment of the invention.
Figure 5A:
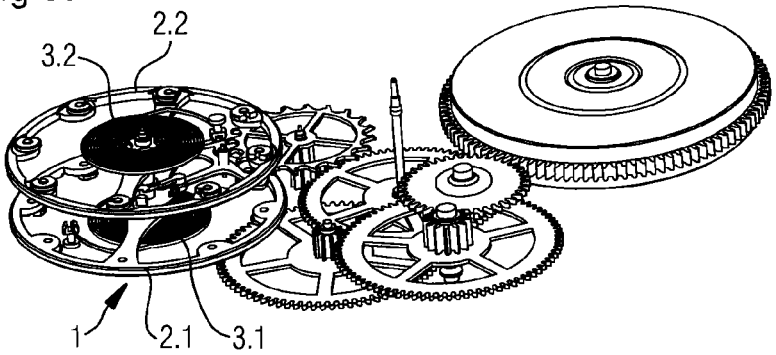
FIG. 5*a* is a perspective view of a regulating organ cooperating with a motor, gearing and an escapement of a watch movement in accordance with an embodiment of the invention.
Figure 5B:
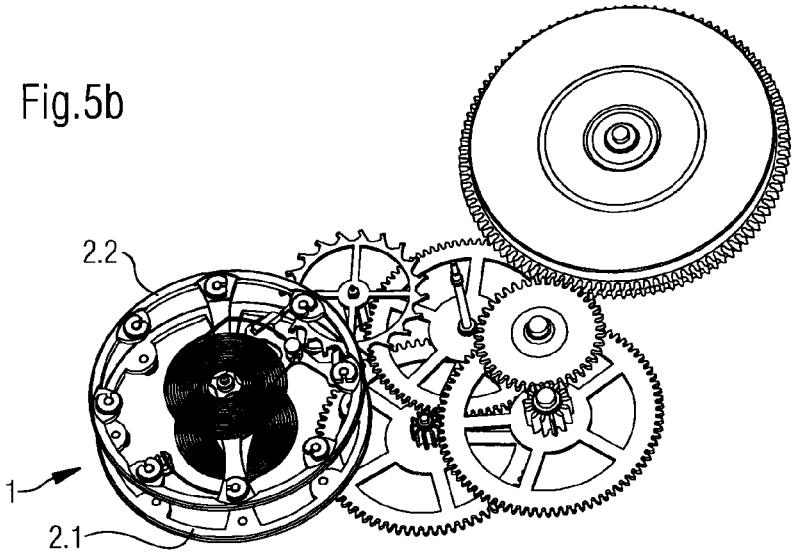
FIG. 5*b* is a perspective view of a regulating organ cooperating with a motor, gearing and an escapement of a watch movement in accordance with an embodiment of the invention.
Figure 6A:
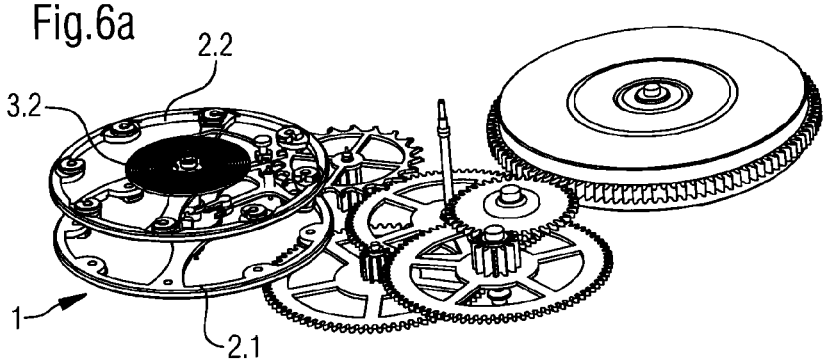
FIG. 6*a* is a perspective view of a regulating organ with a single spiral cooperating with a motor, gearing and an escapement of a watch movement in accordance with an embodiment of the invention.
Figure 6B:
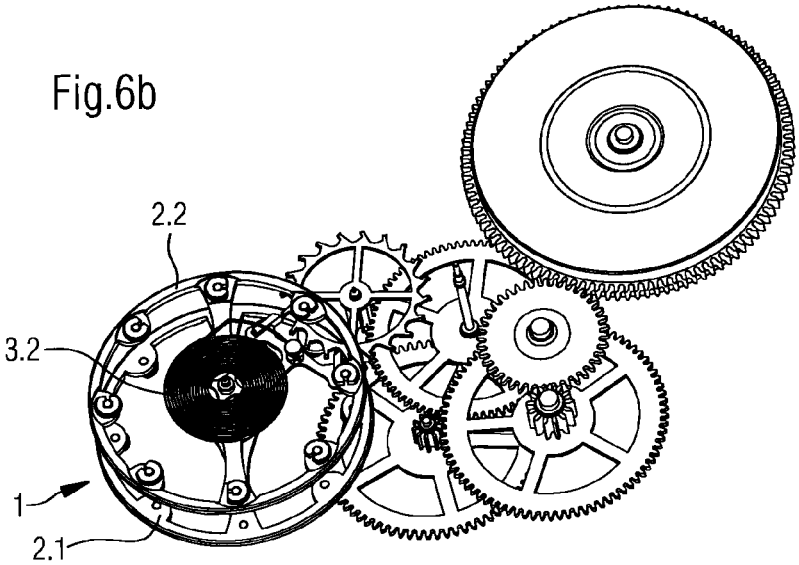
FIG. 6*b* is a perspective view of a regulating organ with a single spiral cooperating with a motor, gearing and an escapement of a watch movement in accordance with an embodiment of the invention.
Figure 6C:
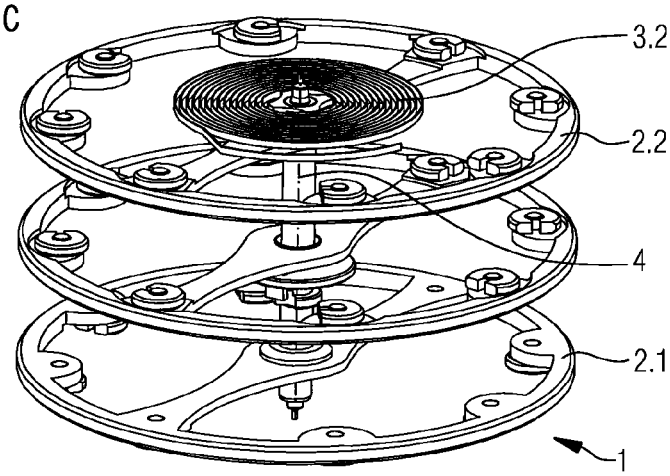
FIG. 6*c* is a perspective view of a regulating organ with a single spiral and a third balance fastened to the axle in accordance with an embodiment of the invention.

It is likewise evident from FIGS. 1 and 2 that the regulating organ 1 according to an embodiment of the present invention also comprises at least a second spiral 3.2 arranged on the second balance 2.2. In an embodiment of the present invention and as illustrated in particular in FIG. 2, said first spiral 3.1 as well as said second spiral 3.2 are each arranged on the side turned toward the outside of said first balance 2.1 and of said second balance 2.2, respectively. This disposition is likewise illustrated in the FIGS. 3*a* and 3*b*, which show a top view of the regulating organ according to an embodiment of the present invention and a top view of the lower part of the regulating organ, respectively, taken along the line IIIb-IIIb indicated in FIG. 2.

A regulating organ comprising the characteristics mentioned above according to embodiments of the present invention therefore presents the following advantages.

On one side, the running precision of a mechanical movement integrating such a regulating organ is improved due to the fact that the inertia of the balance has been approximately doubled without thereby increasing the device's diameter. Likewise, the precision of the balance's period of oscillation can be considerably enhanced in case of utilizing two spirals, in particular in case of utilizing flat spirals. The latter can be replaced by spirals of the Breguet type or by any different type of spirals known to a person skilled in the art, but it is preferable to employ, in an embodiment according to the present invention, two or a generally even number of simple flat spirals, because of the fact that these allow achieving practically the same performance result in terms of the movement's running precision as compared to using spirals of a Breguet type, or a better result if the spiral's Breguet curve is not perfectly mastered. The regulating organ according to an embodiment of the present invention, which utilizes two balances and two spirals, therefore allows optimizing the precision of the oscillation of the balance, without however requiring an excessive complexity or bulkiness of the device, which permits realizing the present invention at relatively moderate production costs.

On the other hand, thanks in particular to the presence of the two balances 2.1, 2.2 mounted on the respective extremities of the device's axle 4, such a regulating organ is ideally adapted for technically and aesthetically highlighting the movement of a mechanical watch. The mechanical watch can in effect be equipped with a watch case comprising, on its two sides, namely on the dial side as well as on the bottom side of the watch, two transparent windows across which the mechanical movement and in particular the oscillation of the balance can be observed. The regulating organ according to the embodiment of the present invention having two balances at the respective extremities 4.1, 4.2 of the axle 4, the oscillation of at least one of the balances 2.1, 2.2 beating in synchronism can therefore be observed in an optimal manner across one of the corresponding windows on the dial side or on the bottom side of the watch case, this without the balance which the observer decided to admire being hidden by other pieces of the mechanical movement.

Moreover, in case of using two spirals corresponding to the two balances and respectively disposed on these latter, the controlling or regulating operations at the time of production or client service are greatly facilitated by a regulating organ according to the present invention, as compared to the devices of prior art. In effect, in the known devices utilizing two spirals, the latter are frequently superimposed on each other, which engenders a viewing difficulty that only allows the person adjusting the watch to distinguish among the two spirals with great difficulty and thus to achieve their start-up only under highly unfavorable conditions. On the contrary, thanks to the use of the two balances 2.1, 2.2, the present invention proposes to separate the two spirals 3.1, 3.2 by a relatively important axial distance, which allows the person adjusting the watch to adequately realize the controlling or adjusting operations or the start-up, this in an almost conventional manner owing to the fact that the two spirals can therefore be considered to be independent, the first spiral 3.1 not disturbing, by superposition, the start-up of the second spiral 3.2.

It remains to be observed that a regulating organ 1 according to other embodiments of the present invention could likewise, in a configuration not illustrated in the figures, comprise more than two balances fastened on the same axle 4, for instance a third balance fastened to the axle 4 of said first balance 2.1 and second balance 2.2 and being arranged between these latter. Moreover, such a regulating organ 1 likewise comprises, in a general fashion, an even number of spirals each mounted on a corresponding balance, for instance a spiral mounted on the first and second balance, respectively, and two spirals mounted on each side of said third balance, or four balances each fitted with a corresponding spiral. The balances, whether two or several, can also have a different diameter, height and/or shape, this within the limits of the available space or of other technical constraints and in accordance with the desired aesthetic appearance. It should further be noted that the spiral or the spirals of the regulating organ according to embodiments of the present invention are mounted on the balance and on the corresponding balance bridges in a conventional manner, by means of a collet and a stud.

A regulating organ according to the present invention can cooperate in a conventional manner with the other parts of the mechanical movement of the watch, namely the motor, the gearing and the escapement of the movement. The escapement of a watch movement incorporating a regulating organ 1 according to the present invention can be arranged at least partially between said first balance 2.1 and second balance 2.2 of the regulating organ 1. A watch movement equipped with such a regulating organ or a watch piece equipped with such a mechanical movement are thus likewise forming the object of the present invention, in particular in the case of such a specific disposition of the escapement.

In the light of the detailed description outlined above, it is clear that embodiments of the present invention propose a regulating organ for a mechanical watch piece whose running precision is improved without excessively increasing its technical complexity or production costs, and which is ideally adapted for being visually highlighted across the windows situated at the two sides of the watch case, thus contributing in an important manner to the aesthetic appearance of the watch piece.

The invention claimed is:

1. A regulating organ of a mechanical watch, comprising:
a first balance and a first spiral, wherein the first balance is fastened to an axle;
at least a second balance fastened on the axle of said first balance and at least a second spiral arranged on said at least second balance.

2. The regulating organ according to claim 1, wherein said first balance and second balance are each positioned on one extremity of the axle.

3. The regulating organ according to the claim 1, wherein the first spiral and the second spiral are positioned on a side turned toward the outside of said first balance and said second balance, respectively.

4. The regulating organ according to claim 1, wherein the spirals are flat spirals.

5. The regulating organ according to claim 1, wherein the spirals are Breguet spirals.

6. The regulating organ according to claim 1, further comprising a third balance fastened on the axle of said first balance and second balance and positioned between said balance and said second balance.

7. The regulating organ according to the claim 6, further comprising an even number of spirals, each spiral mounted on a corresponding balance.

8. A watch movement comprising:
a motor;
a gearing;
an escapement; and
a regulating organ including—
a first balance and a first spiral, wherein the first balance is fastened to an axle,
at least a second balance fastened on the axle of said first balance and at least a second spiral arranged on said at least second balance,
wherein the gearing transmits a driving power coming from the motor to said escapement, and said escapement is in cooperation with said regulating organ, so as to maintain oscillations of the regulating organ, wherein the escapement is positioned at least partially between said first balance and second balance of the regulating organ.

9. A mechanical wrist watch, comprising a regulating organ, said regulating organ including—
a first balance and a first spiral, wherein the first balance is fastened to an axle;
at least a second balance fastened on the axle of said first balance and at least a second spiral arranged on said at least second balance.

10. A mechanical wrist watch, comprising a watch movement, said watch movement including—
a motor;
a gearing;
an escapement; and
a regulating organ including—
a first balance and a first spiral, wherein the first balance is fastened to an axle,
at least a second balance fastened on the axle of said first balance and at least a second spiral arranged on said at least second balance,
wherein the gearing transmits a driving power coming from the motor to said escapement, and said escapement is in cooperation with said regulating organ, so as to maintain oscillations of the regulating organ, wherein the escapement is positioned at least partially between said first balance and second balance of the regulating organ.

11. A regulating organ for a mechanical watch, comprising:
a balance axle having opposed end portions;
a first balance and a second balance operatively, fixedly coupled to respective ends of said opposed axle end portions for mutual synchronous beating of said first and second balances;
a first spiral operably coupled to said axle; and
at least a second spiral arranged on said at least second balance.

12. The regulating organ for a mechanical watch according to claim 11, wherein said first balance and second balance are each positioned on one extremity of the axle.

13. The regulating organ for a mechanical watch according to the claim 11, wherein the first spiral and the second spiral are positioned on a side turned toward the outside of said first balance and said second balance, respectively.

14. The regulating organ for a mechanical watch according to claim 11, wherein the spirals are flat spirals.

15. The regulating organ for a mechanical watch according to claim 11, wherein the spirals are Breguet spirals.

16. The regulating organ for a mechanical watch according to claim 11, further comprising a third balance fastened on the axle of said first balance and second balance and positioned between said balance and said second balance.

17. The regulating organ according to the claim 16, further comprising an even number of spirals, each spiral mounted on a corresponding balance.

* * * * *